US010116048B2

(12) United States Patent
Mielke et al.

(10) Patent No.: US 10,116,048 B2
(45) Date of Patent: Oct. 30, 2018

(54) ANTENNA WITH ROTATABLE RADIATING ELEMENT

(71) Applicant: KATHREIN-Werke KG, Rosenheim (DE)

(72) Inventors: Manuel Mielke, Rosenheim (DE); Josef Fahrenschon, Rosenheim (DE); Manfred Stolle, Rosenheim (DE); Andreas Plötz, Rosenheim (DE)

(73) Assignee: KATHREIN-WERKE KG, Rosenheim (DE)

( * ) Notice: Subject to any disclaimer, the term of this patent is extended or adjusted under 35 U.S.C. 154(b) by 274 days.

(21) Appl. No.: 15/071,749

(22) Filed: Mar. 16, 2016

(65) Prior Publication Data

US 2016/0276746 A1 Sep. 22, 2016

(30) Foreign Application Priority Data

Mar. 16, 2015 (DE) ..... 10 2015 003 358

(51) Int. Cl.

| | |
|---|---|
| ***H01Q 3/04*** | (2006.01) |
| ***H01Q 1/24*** | (2006.01) |
| ***H01Q 1/42*** | (2006.01) |
| ***H01Q 1/12*** | (2006.01) |
| ***H01Q 21/28*** | (2006.01) |

(52) U.S. Cl.

CPC ..... *H01Q 3/04* (2013.01); *H01Q 1/125* (2013.01); *H01Q 1/246* (2013.01); *H01Q 1/42* (2013.01); *H01Q 21/28* (2013.01)

(58) Field of Classification Search

CPC ..... H01Q 3/04; H01Q 1/125; H01Q 1/246; H01Q 1/42; H01Q 21/28

See application file for complete search history.

(56) References Cited

U.S. PATENT DOCUMENTS 4,163,961 A 8/1979 Woodward
6,351,248 B1 * 2/2002 Hill ..... H01Q 1/246 343/789

(Continued)

FOREIGN PATENT DOCUMENTS

FR 2938981 5/2010

OTHER PUBLICATIONS

Extended European Search Report issued in EP 16160307.1 dated Jul. 27, 2016.

(Continued)

*Primary Examiner* — Dameon E Levi

*Assistant Examiner* — David Lotter

(74) *Attorney, Agent, or Firm* — Dann, Dorfman, Herrell and Skillman; Stephen Eland

(57) ABSTRACT

The invention teaches a telecommunications antenna with a housing comprising a radome (12) and a radiator (70) arranged in the housing, wherein the radiator (70) is mounted to a support structure (30) that is conductive in the electromagnetic sense, said support structure so engaging the housing that it is in either one of a rotatable fashion or a rotatably fixed fashion about and axis, in that at least one body (80) that is non-conductive in the electromagnetic sense is tensionable in a direction parallel to the axis in such a fashion that a transition from the rotatable fashion to the rotatably fixed fashion is permitted by forming a frictional engagement.

17 Claims, 2 Drawing Sheets

(56) References Cited

U.S. PATENT DOCUMENTS

| | | | | |
|---|---|---|---|---|
| 8,416,144 | B2 | 4/2013 | Lindberg et al. | |
| 2006/0044207 | A1* | 3/2006 | Dolson | H01Q 1/12 343/878 |
| 2007/0030208 | A1 | 2/2007 | Linehan | |
| 2007/0198224 | A1* | 8/2007 | McGuire | H01Q 1/084 702/188 |
| 2008/0180338 | A1 | 7/2008 | Duk-Yong | |
| 2009/0289158 | A1 | 11/2009 | Nelson et al. | |
| 2012/0038540 | A1 | 2/2012 | Jacob et al. | |
| 2012/0119055 | A1 | 5/2012 | Mimura | |
| 2012/0154239 | A1* | 6/2012 | Bar-Sade | H01Q 1/1242 343/839 |

OTHER PUBLICATIONS

DE Search Report issued in DE 10 2015 003 358.1 dated Jul. 28, 2015.

* cited by examiner

ANTENNA WITH ROTATABLE RADIATING ELEMENT

CROSS-RELATION TO OTHER APPLICATIONS

This application claims priority of and benefit to German Patent Application No. DE 10 215 003 358.1 "Antenna mit drehfähigem Strahler (Antenna with rotatable emitter)" filed on 16 Mar. 2015, the full disclosure of which is incorporated herein by reference.

FIELD OF THE INVENTION

The present invention relates generally to the field of telecommunication antennas and, in particular, the invention relates to a telecommunications antenna which can be used both in indoors and the outdoors.

BACKGROUND OF THE INVENTION

In particular during the past few years, so-called micro-cell antennas have been used with increasing frequency. There is a need in the micro-cell antennas to take into account the construction of the surrounding area. In order to be able to cover defined areas in a targeted manner, a large variety of attempts have been made to provide telecommunications antennas or antenna arrays in which the whole of the telecommunications antenna or individual radiating elements of the telecommunications antenna are either controlled electronically, driven by a motor drive or provided with a possibility of mechanical adjustment. However, in general, the prior art solutions only allow a limited possibility of adjustment and, as soon as an adjustment is required that is substantially mechanical in nature, a substantial risk of so-called intermodulation occurs, since non-defined metal-on-metal contacts regularly exist between individual elements of the telecommunications antenna. The non-defined metal-on-metal contacts can impair the transmitting properties or reception properties of the telecommunications antenna due to temperature changes and also upon change of orientation.

BRIEF SUMMARY OF THE INVENTION

This disclosure teaches a telecommunications antenna which enables a large range of adjustment possibilities and simultaneously can at least partially prevent intermodulation.

The telecommunications antenna of this disclosure has a so-called radome-containing housing in which a radiator is arranged, wherein the radiator is mounted on an electroconductive support structure, for example a metallic support structure, which engages the housing selectively in either one of a rotatable fashion or a rotatably fixed fashion about an axis, in which housing at least one non-electroconductive body, for example a plastic body, is tensionable in a direction parallel to the axis, in such a fashion that a transition from the rotatable fashion to the rotatably fixed fashion is permitted by means of a frictional engagement.

Within the meaning of the present application, the terms rotatable and rotatably fixed are to be understood to mean that in the rotatable state, a relatively low torque is required in order to effect a rotation of the support structure with reference to the housing, of approximately 2-3 Nm, whereas the term rotatably fixed is to be understood to mean that a substantially higher torque is required in order to effect a rotation, for example within a range of 7-10 Nm. Since the support structure usually also has the connector sockets for the cable connection of the telecommunications antenna, the torque that corresponds to a rotatably fixed configuration should be high enough at any rate to prevent an unintended rotation or twisting, for example through its own weight or through the tightening of the cables due to the cables being screwed to the connector sockets or, in outdoor applications, due to wind pressure.

It has been found in a very surprising manner that the phenomenon of intermodulation can be practically eliminated by being able to tension two parts of the telecommunications antenna movable relative to each other by means of a non-electroconductive body, such that there is no risk of intermodulation at least with respect to this non-electroconductive body and the support structure for the radiator, which is usually made of metal.

This effect can be further reinforced by providing a non-electroconductive bracket section, wherein the bracket section has, for example, an annular shape, in order to receive the support structure therein. This bracket ring can be manufactured as a plastic ring and can additionally be equipped with an attachment section, in order to be able to mount the telecommunications antenna on a building, a mast or the like. While it is preferred to manufacture the bracket section in its entirety of plastic, the person skilled in the art should recognize that, for example, for fixation to the building, metallic components or sections may still be used. In order to achieve the optimized prevention of intermodulation, the electroconductive (usually metallic) support structure can be tensioned by the non-electroconductive body against a similarly non-electroconductive bracket section. Thus, an intermetallic connection is not only prevented between the tensioned body and the support structure, but also with respect to any other metallic interaction.

In a further aspect, the support structure is configured to be pot-shaped, in particular having a cylindrical wall extending with reference to the axis over a length of at least $\lambda/20$, ideally $\lambda/10$, for example corresponding to 15 mm at 2 GHz of the wavelength of the average operating frequency $\lambda$ of the radiator that is arranged or is to be arranged in the telecommunications antenna. The pot-shaped configuration of the electroconductive support structure permits on the one hand the incorporation of the cylindrical wall into the housing. The cable guides are usually provided on the support structure and can be executed so as to be shielded by the support structure, such that, through the pot-shaped configuration, the high-frequency currents, in particular the high-frequency mantle currents on the feeder cables, can remain on the inside of the pot, and are thus in a defined volume pointing towards the radiator. In this manner, the intermodulation can be even further reduced, in particular when it is taken into account that, with the exception of the metallic parts of the radiator itself, any metallic element, such as for example a screw for attaching the radiator or also external screws of the housing structure are provided in such a fashion that a corresponding shielding can be ensured by the pot shape.

Advantageously, the support structure has an annularly protruding edge that can be brought into engagement with a groove in the housing. By such a configuration, a guided pivot bearing can be executed, wherein the protruding edge, particularly when provided in connection with a cylindrical wall, can rudimentarily provide a so-called labyrinth seal, such that the intrusion of dirt and water can be prevented. The annularly protruding edge, which can engage in interaction with a corresponding groove in the housing, additionally permits making available an easily calculable frictional engagement, by simply multiplying the corresponding surfaces with the corresponding tension force, such that the configuration of the complete telecommunications antenna can be determined easily, since it is possible for the person skilled in the art to ascertain the torque increase resulting from a tensioning action.

Since the telecommunications antenna of the description can be used both indoors and in the outdoor environment, the support structure engages the housing via an O-ring. The O-ring provides both a sealing function and a slight frictional inhibition. For example it would be possible to introduce a groove in the cylindrical wall, in which an O-ring can then be received. This O-ring would on the one hand seal the transition between the support structure and the housing and, in the absence of a tension in an axial direction, it would still be possible to rotate the support structure with respect to the housing, since such a rotation is counteracted merely by the tension of the O-ring. However, the rotation is advantageously slightly inhibited, such that an exact angular adjustment can be achieved particularly easily.

Furthermore, at least one non-electroconductive spacing element may be provided between the support structure and the radiator and/or between the radiator and the radome. For the decoupling between the support structure and the radiator, in order to avoid an impairment of the radiation properties of the radiator by the support structure, the radiator can be arranged in an axial direction at a defined distance from the support structure. For example, a plastic part can be used which engages the support structure (preferably in rotationally fixed fashion) and could, for example be a screw extending in the direction of the axis. At the other end of this plastic part the radiator itself can be arranged. Alternatively or additionally, it is also possible to hold the radiator centered in the housing by, for example, providing a spider-shaped arrangement at the distal end of the radiator, which is in one aspect also executed as a plastic part.

In a further aspect the support structure has a rotation aid (for example an integrally molded hexagonal pin) and/or an angular indication or an angular indexation. As mentioned above, this disclosure teaches a large adjustment potential in that the radiator can be rotated about the axis by practically 360 degrees. However, in some applications it can be desirable that the user can use a marking indicating the degree of rotation upon adjustment of the telecommunications antenna, in order to be able to set and read off a desired orientation. Furthermore, an indexation can be advantageous, when for example predetermined angular adjustments are desired. It could be specified, for example, that for these special angular arrangements a different torque would be required in order to reach or leave this angular position. This could be implemented, for example, by means of notches or protrusions on the surface of the support structure that is oriented towards the tensioning body.

In a further aspect, the non-electroconductive body is a clamping body, in particular affixed by fastener. The fastener may be any of a variety of fasteners, including, but not limited to a threaded fastener, such as a screw and also includes items such as a quick release. The fastener engages advantageously the non-electroconductive bracket section. The fastener will usually be manufactured in metal, however in an embodiment with a non-metallic bracket, the non-metallic bracket interacts with this non-metallic body, such that no intermetallic interaction occurs in this case either. The thus affixed body itself, which is non-metallic or, as explained in this disclosure, as non-electroconductive, in turn affixes the support structure which will most frequently be metallic, but in any case electroconductive, such that no engagement is present here either between two different, electroconductive parts.

It is advantageous when for example, in a pot-shaped configuration of the support structure, that the metallic parts are shielded by the support structure. Insofar, it is desirable that the clamping body screw and/or the clamping body fastener and/or a fastener provided on the support body for fixing the spacer or the radiator does not extend beyond the extension of the support body in the direction of the radiator. Consequently, electromagnetic interference can be prevented even further, since practically no metallic objects whatsoever are present in the area of the radiator or of the feeder cables. In a further aspect, in addition to the support structure and the radiator arrangement itself, only the fasteners are metallic. These fasteners are exclusively between two non-metallic parts, such that any metal-on-metal transition can effectively be prevented, with the exception naturally of the cables required for feeding, in particular between the connector sockets which will usually be formed on the support structure and the radiator itself.

For the purpose of making available an equal force distribution and/or preventing tilting problems, the non-electroconductive body can be configured as a claw or a catch with two legs permitting affixation, for example, on diametrically opposing sections. This configuration permits tensioning of a peripheral zone of the support structure, wherein for example connectors present within this peripheral zone do not lead to an interaction of any kind upon a desired rotation, since the legs can be present outside of the area which is occupied by the connectors. The configuration as a claw with two legs additionally permits a defined tension between the support structure and the housing and avoids excessive material stresses.

In one aspect, the claw is provided with a tensioning section at its end, i.e. at the end of the legs. The tensioning section can protrude beyond a reference plane by for example 0.6 mm, as defined adjacent to the fastener, for tightening the non-conductive body in the electromagnetic sense. Such a tensioning property of the claw permits, for example, a relaxation of the tightening between the support structure and the housing, subsequent to which the frictional engagement between the claw and the support structure occurs only with regard to a very small surface, such that the required torque is hardly influenced thereby. In a further aspect with an O-ring as a result the rotation inhibition is substantially due to the O-ring.

In the base area of the claw a protrusion is provided in order to be able to provide, for example, a tolerance compensation, if, for example, the groove in the housing is formed slightly deeper than the thickness of the protruding edge. Alternatively or additionally, a tensioning section can be provided also in the base area, such that carrying out the tightening leads to a defined degree of tightening between the support structure and the housing.

Although the present invention can be used in principle for any of a variety of geometries of telecommunications antennas, it has been found that the arrangement is advantageous if the housing is formed cylindrically in its entirety, but at least in the area of the reception radiator, i.e. the radome. A cylindrical shape is advantageous both with respect to the wind pressure as well as optically. The cylindrical shape offers an arrangement possibility for the radiator by which as little space is lost as possible, such that the radiator can be rotated by practically 360 degrees. In a particularly simple aspect, the radome is, for example, a glass reinforce pipe ("GRP pipe"), which can then, for example, be configured with a support structure at one end. The support structure seals the end in a plug-like fashion and supports the radiator on the inside of the radome. This arrangement then permits an arbitrary rotation of the radiator without tension, in order to provide a desired orientation. As soon as the desired orientation has been obtained, it is sufficient to carry out the tensioning by means of the non-electroconductive body. The term "substantially cylindrical" is to be understood here to mean that connecting sections serving as fixations to the building are not detrimental to the cylindrical configuration.

At least one pressure-responsive element and/or a securing device and/or a guide is provided in an axial direction for the non-electroconductive body. A pressure-responsive element can be configured, in particular, in the form of a valve or a membrane on the support structure, in order to be able to account, for example, for temperature variations. The pressure-responsive element prevents the formation of a condensate in the body. The pressure-responsive element can optionally also be used for checking the sealing of the telecommunications antenna by applying overpressure or under pressure. A securing device for the non-conductive body is executed, for example, as a clamping body and ensures that easy mounting is made possible, since the telecommunications antennas are frequently mounted at a substantial height. An additional guide in an axial direction, for example by means of shape complementarity can further contribute to preventing the claw-shaped clamping body from tilting, such that an even more homogeneous tensioning can be ensured.

Finally, the telecommunications antenna has at least two radiators mounted on two electroconductive support structures, which are disposed in corresponding, distal sections of the radome and are executed in particular as identical elements. As already noted above, for example the telecommunications antenna can comprise a cylindrical radome with two support structures, for example made of metal, at the ends, to which the support structures or the radiators are fixed, which are then arranged on the inside of the radome, such that the corresponding angular positions can be adjusted and fixed independently of each other. As a result, with such a telecommunications antenna for example a street junction could be supplied particularly well, by aligning different ones of the radiators with intersecting streets.

The person skilled in the art will recognize that within the framework of the present invention diverse changes and modifications are possible and in particular that the various features of individual preferred embodiments and aspects can be combined as desired with other features of other preferred embodiments. A broader understanding of the present invention can be gathered by the person skilled in the art also from the subsequent detailed description of preferred embodiments, which description is to be considered as merely exemplarily and non-limiting.

BRIEF DESCRIPTION OF THE DRAWINGS

The description makes reference to the enclosed drawings, in which there is shown.

DETAILED DESCRIPTION OF THE INVENTION

Figure 1:
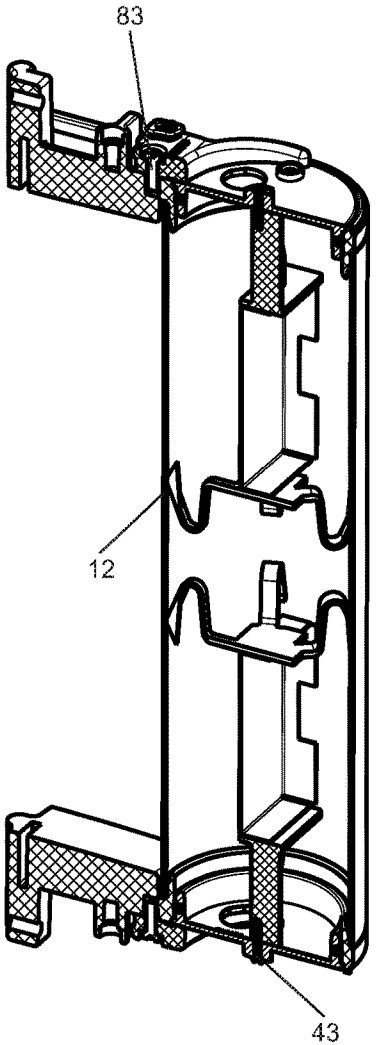
FIG. 1 shows in a perspective cross-sectional view an arrangement for providing a telecommunications antenna, wherein the arrangement is illustrated without radiator or corresponding cable-connection.
Figure 9:
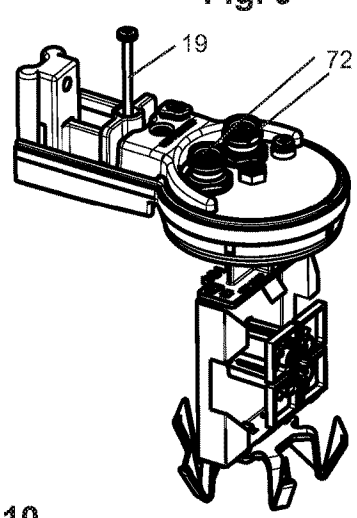
FIG. 9 is a depiction similar to FIG. 6 with mounted radiator.
Figure 11:
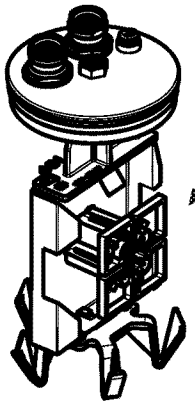
FIG. 11 is a depiction similar to FIG. 3 with mounted radiator.
Figure 10:
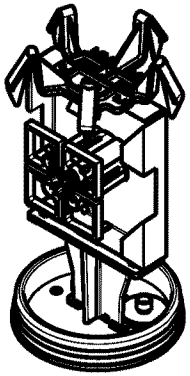
FIG. 10 is a depiction similar to FIG. 2 with mounted radiator.
Figure 8:
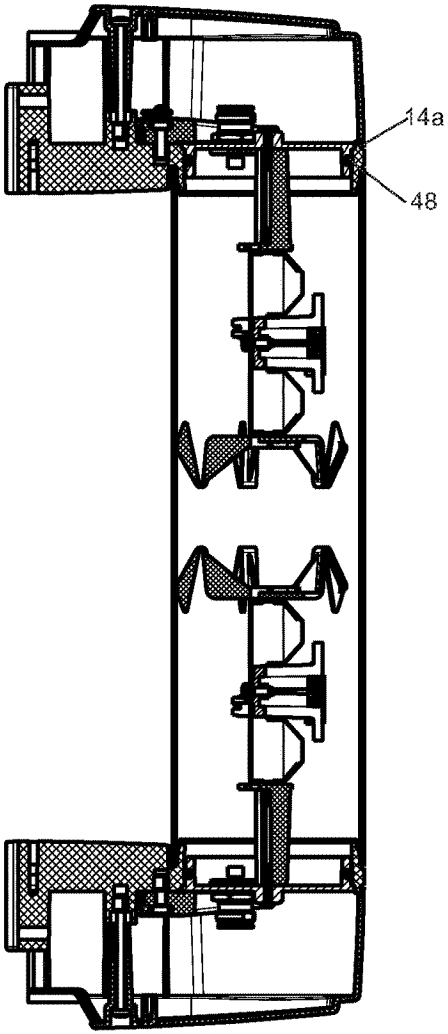
FIG. 8 shows the telecommunications antenna of FIG. 7 in a cross-sectional view.
Figure 7:
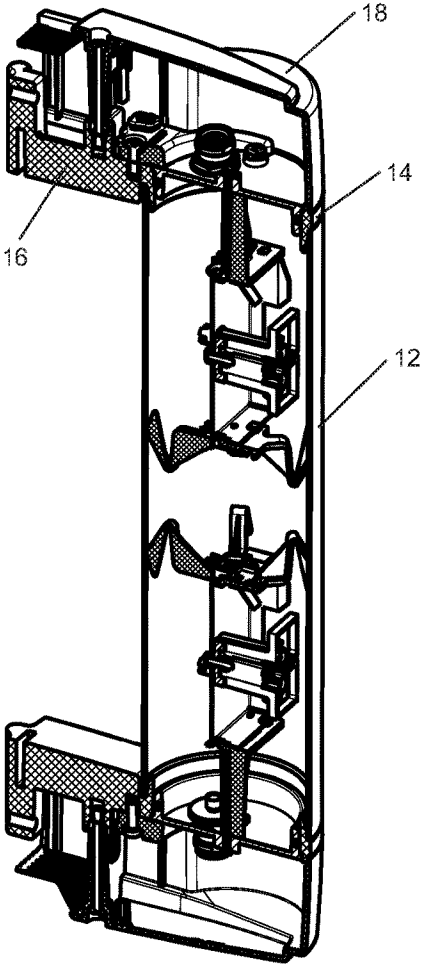
FIG. 7 shows a sectional view similar to FIG. 1 of a telecommunications antenna in accordance with an embodiment with mounted radiators.

In FIG. 1 an arrangement of the telecommunications antenna is illustrated in which radiators can be mounted to form the telecommunications antenna. The arrangement comprises a cylindrical housing section 12 which is usually also referred to as radome. This cylindrical housing section 12 serves to receive the radiators of the telecommunications antenna in the finished telecommunications antenna and to protect them against damage, soiling or other influences. This housing section 12, which is depicted in a non-limiting manner in a cylindrical fashion in FIG. 1, can be provided in the form of a GRP pipe section having a circular diameter of around 10 centimeters.

On the inside of the housing section 12, radiator receiving means 64 are arranged in an upper area and a lower area. The radiator receiving means 64 are arranged centered in the housing part 12 by means of a spacer 66, which will be described later in the course of the present description. The radiator receiving means 64 are provided at their distal ends with a further spacer 62, in order to determine the position of the radiators in an axial direction and in a radial direction. These radiator receiving means 64 are executed in one aspect in an electroconductive material and act as reflector for the radiator 70 to be mounted on the radiator receiving means 64.

At the distal end of the spacing parts or spacers 63, an electroconductive support structure 30 is disposed, which is configured in the shape of a metal pot in the illustrated embodiment. The support structure 30 is coupled to the spacer 62 via a screw 43. The position of the screw 43 coincides with the center axis of the housing section 12, with respect to which a rotatable radiator element 70 to be mounted later can be rotated through the support structure 30. The engagement between the spacer 62 and the support structure 30 itself is made non-rotatable by means of suitable provisions (one example is protrusions on the inner surface of the support structure).

The support structure 30, here shown in the shape of a metal pot with a protruding edge 34, is present on the inside with a bracket ring 14 of the housing and, with the protruding edge, abuts against an upper groove **14*a* formed in the bracket ring 14. The annular bracket ring 14 in the embodiment illustrated here is coupled to the cylindrical housing section 12, but could also be executed integrally with the cylindrical housing section 12. On the inside of the bracket ring 14, forming a part of the cylindrical housing section 12, there extends a cylindrical wall 36 of the support structure 30 that is equipped with an O-ring 48**.

The housing part 14, configured as a bracket ring, is provided with an extension 16 on its left side which serves for coupling with a housing section or a carrier mast. In the immediate vicinity of the annular bracket ring 14 or the housing section 12, a screw 83 fixes a body which is non-electroconductive, in the example a plastic claw 80, in order to permit tensioning of the support structure in an axial direction with respect to the housing, or more precisely with respect to the bracket ring 14. As can be seen, the screw 83 extends only in the non-metallic bracket, such that in the embodiment illustrated here, the plastic claw 80 couples to the non-metallic bracket by means of the metallic screw, in order to clamp the metallic support structure 30 between the non-metallic housing and the non-metallic clamping element 80. As can be seen, the metallic screw 43 provides a coupling between the support structure and the spacing element 62 and extends only slightly in an axial direction, such that no metallic protrusion is present which will protrude beyond the cylindrical wall 36 of the pot-shaped support structure.

By means of the screw 83, it is possible to create a defined resistance on the support structure 30 via the claw-like clamping bodies 80. When the screw 83 is in a loosened state, the support structure 30 can be rotated in the cylindrical shaped housing relatively easily. In this case only the resistance formed by the O-ring and the negligible friction forces counteract the rotation. However, it should be noted that the O-ring resistance provides a certain rotational inhibition, which will facilitate an adjustment with regard to an angle, as will be described in detail later.

As soon as the desired orientation has been achieved and of course with prior mounting of a corresponding radiator, the screw 83 can be tensioned or tightened, in order to effect a tensioning in an axial direction of the support structure, such that the protruding edge 34 of the support structure 30 can enter into frictional engagement with the groove 14*a* of the bracket ring 14.

Figure 3:
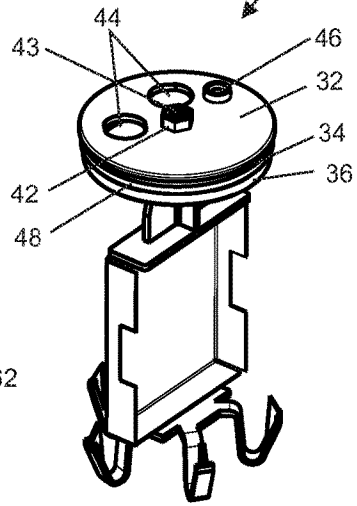
FIG. 3 shows a further perspective view of the object shown in FIG. 2.
Figure 2:
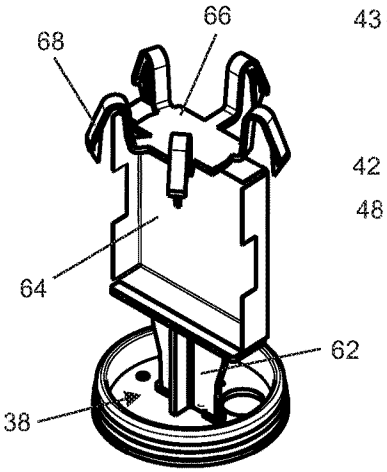
FIG. 2 shows in a perspective view a support structure usable in the present invention with a radiator receiving element and two spacers.

In FIGS. 2 and 3 the support structure 30 with two spacers and the radiator receiving means 64 is shown in greater detail in two different perspective views. In FIG. 2 the pot-shaped configuration of the support structure 30 can be seen clearly, which defines an internal volume 38 in which a cylindrical wall 36 protrudes in an axial direction from the disk-shaped base body 32 of the support structure 30. The cylindrical wall 36 in the depicted embodiment has an axial extension of $\lambda/10$, this value has turned out to be particularly advantageous, since the surface currents thus remain on the inside of the pot and do not pass to the outside of the support structure. This passage to the outside would have substantial disadvantages with reference to the intermodulation safety of the complete antenna structure. Peripherally, the protruding edge 34 is provided in addition, which protrudes radially beyond the cylindrical wall 36, protruding in particular in such a fashion that a counter-bearing arrangement is permitted with the bracket ring 14 shown in FIG. 1, in particular with the groove 14*a* formed therein. In the cylindrical wall in addition an O-ring 48 is provided in a corresponding groove, such that the support structure 30 can be introduced in a cylindrical opening in the fashion of a plug. The O-ring can advantageously be equipped with a PTFE coating, in order to facilitate sliding upon rotation. On the inside of the support structure element a spacer 62 is provided on the distal end of which the radiator receiving means 64 is disposed in turn. At the upper end of the embodiment shown in FIG. 2 a further spacer 66 is provided, which is equipped with support tabs 68, in order to provide a spider-like configuration which permits holding also the distal end of the radiator holding means 64 centered in the cylindrical housing.

It can be seen clearly in FIG. 3 that two receiving openings 44 are provided in the support structure, in order to receive the corresponding connectors mentioned above. The connectors can then be coupled to the radiator element to be mounted and serve for connecting the telecommunications antenna externally. It is further shown that the screw 43 is provided in a hexagonal configuration 42, which being provided substantially in the center is provided as a rotation aid. On the basis of the hexagonal configuration, the angular position of the support structure can be adjusted easily by means of a wrench. Finally, a pressure-responsive element 46 is illustrated, which can provide pressure compensation in the completely mounted telecommunications antenna in the otherwise sealed telecommunications antenna. The pressure-responsive element 46 can also be used for checking the sealing state of the telecommunications antenna by applying for example overpressure or a vacuum.

Figure 5:
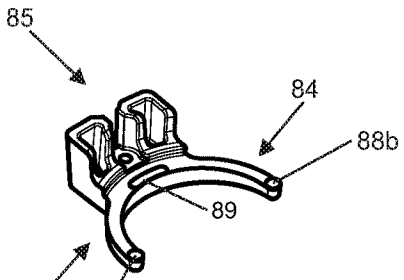
FIG. 5 shows the body shown in FIG. 4 in a perspective view, viewed from below.
Figure 4:
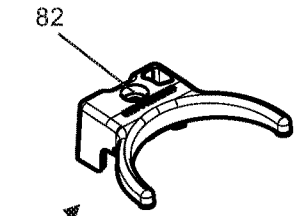
FIG. 4 shows a perspective detail view from above of a non-conductive body in the electromagnetic sense that is usable in the present invention.

In the FIGS. 4 and 5 the clamping element of plastic is designated 80 (having the claw-like shape as indicated in FIG. 1) and is reproduced in two different perspective views. A through bore 82 provided with a countersunk edge can be seen clearly, through which the screw 83 can be screwed into the housing bracket. It should be noted here that also different fasteners, such as e.g. a quick release, can be used. Further, it can be seen clearly that the clamping element or the clamping body of plastic is of substantially claw-like configuration, having two legs 84 and 86 which extend substantially in a semicircle and at their ends are equipped with biasing protrusions 88*a* and 88*b* (exemplarily protruding by 0.6 mm with reference to the abutment surface adjacent to the through bore). Further, it can be seen that on the lower side of the clamping body in the area of the basis, from which the legs extend, a further biasing knob 89 is provided in addition (exemplarily protruding by 0.2 mm with reference to the abutment surface adjacent to the through bore), such that in the embodiment shown here a tensioning of the support structure is permitted in three points at correspondingly 0 degrees and +/−90 degrees. It can further be seen in FIG. 5 that the base section of the claw-like shape with the reference numeral 85 has a configuration which permits guidance in axial direction.

Figure 6:
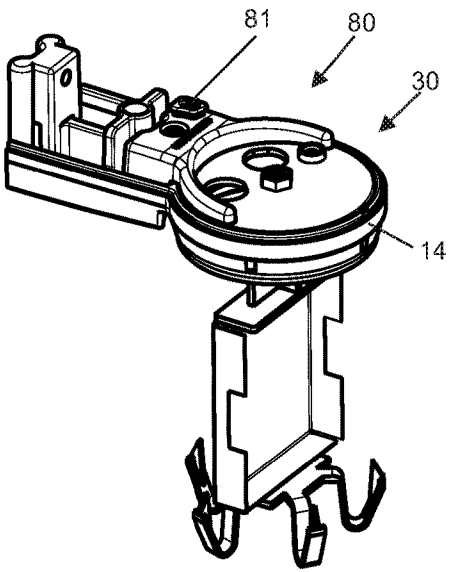
FIG. 6 shows in a perspective manner an arrangement of a bracket and a support structure, corresponding to the upper section of FIG. 1, wherein a portion of the housing has been omitted for the sake of clarity.

In FIG. 6 the bracket is shown in detail, with a pot-shaped support structure 30 arranged in the bracket ring 14. The support structure 30 is tensional by the claw-like clamping bracket (clamping body/element) described above. In the embodiment shown in FIG. 6 a securing device is additionally indicated by reference numeral 81, which can be provided for example by means of a wire or a string, connected to the clamping body 80 on the one hand and the bracket 16 on the other hand.

In the FIGS. 7 to 11 now a finished, mounted telecommunications antenna is shows as an embodiment of the invention. Many of the elements illustrated in FIGS. 1 to 6 can be found in the FIGS. 7 to 11 and will not be described again here in detail. Additionally, there is now shown one radiator, indicated by the reference numeral 70, as well as two end covers (provided at the corresponding distal ends) 18, which can be fixed by means of corresponding screws 19.

As can be seen from the figures, in the embodiment depicted here with two radiators 70, the two radiators 70 can be rotated independently of each other with reference to the center axis of the cylindrical body through the support structure 30 being rotatable with reference to the bracket ring 14. In a corresponding vertical arrangement of the telecommunications antenna consequently different angular ranges can be covered, such that for example a micro-cell structure can be achieved easily, in that the telecommunications antenna, arranged for example at the junction of two streets, can be oriented correspondingly in order to be able to supply one street section each with mobile communication signals. In a horizontal mounting of a corresponding telecommunications antenna, for example, one radiator could be directed obliquely downwardly, in order for example to supply the lower floors of a building opposite, while the other radiator, could be directed obliquely upwardly, could for example supply the upper floors. It can be seen that the adjustment possibilities of the telecommunications antenna according to the invention are very high. The adaptation can take place easily by bringing the support structure 30 out of frictional engagement with the housing, in particular with a surface of the groove 14*a* of the bracket ring 14, in order to permit a change of orientation, after which by a renewed tightening of the corresponding fasteners or screws, the frictional engagement is restored, in order to provide for locking against rotation.

Here, an indexing or an angular marking system can be expedient in order to be able, for example, to adjust to predetermined angles easily, which are specified by, for example, the network planner. The telecommunications antenna is then installed by the electrician in each case at the predetermined angle in the place of installation at a defined height and at a certain house wall of the house. The floor plans of the houses have fixed coordinates on the basis of which the network planner can orient (plan) the telecommunications antenna and provide the electrician with the information (e.g. radiator 1 place at −45° and radiator 2 place +45°).

Although the present invention was described above completely with reference to currently preferred embodiments, the person skilled in the art should recognize that various changes and modifications are possible within the framework of the claims without deviating from the basic idea of the invention. Although the telecommunications antenna was described above as having two independently rotatable support structures and associated radiators, it can be seen that it is likewise possible to provide the telecommunications antenna with a total of only one radiator, which could then optionally be connected to an upper support structure, a lower support structure or possibly also with both support structures. For the case that merely one radiator is provided which would be connected to both structures, it would have to be ensured that no frictional engagement exists at the two distal ends, in order to provide for a corresponding change of orientation. It should also be mentioned that in the embodiment with two independent radiators, it is also possible to provide respectively a multiplicity of radiators on the corresponding upper or lower support structure, in order to permit for example providing different frequency ranges upon corresponding geometric orientation.

LIST OF REFERENCE NUMBERS

12 radome
14 bracket ring
14*a* groove of the bracket ring
16 wall bracket section
18 end cover
19 end cover screw
30 support structure
32 disk- or plate-shaped support structure section
34 protruding edge of the support structure
36 cylindrical wall of the support structure
38 internal volume of the support structure
42 rotation aid
43 spacer fixing screw
44 connector openings
46 pressure-responsive element
48 O-ring
62 spacer
64 radiator receiving means
66 radial spacer
68 support element of the spacer
70 radiator element
72 connector sockets
80 electromagnetically non-conductive body (clamping body)
82 bore
84 first leg
85 axial guide
86 second leg
88*a*, 88*b* biasing protrusions
89 center biasing protrusions

The invention claimed is:

1. A telecommunications antenna with a housing comprising a radome and a radiator arranged in the housing, wherein the radiator is mounted on an electroconductive support structure, wherein the electroconductive support structure engages the housing in either one of a rotatable fashion or in a rotatably fixed fashion about an axis through at least one non-electroconductive body and is tensionable in a direction parallel to the axis so that a transition from the rotatable fashion to the rotatably fixed fashion is effected by forming a frictional engagement, wherein the non-electroconductive body is a clamping body and wherein the non-electroconductive body is tensionable by a fastener engaging in a non-electroconductive bracket section.

2. The telecommunications antenna according to claim 1, wherein the housing comprises further said non-electroconductive bracket section.

3. The telecommunications antenna according to claim 1, wherein the electroconductive support structure is configured to be pot-shaped.

4. The telecommunications antenna cording to claim 3, wherein the electroconductive support structure has a cylindrical wall that extends with reference to the axis over a length of at least $\lambda/20$, wherein $\lambda$ is the average operating frequency of the telecommunications antenna.

5. The telecommunications antenna according to claim 1, wherein the electroconductive support structure has an annular protruding edge configured to be engaged with a groove in the housing.

6. The telecommunications antenna according to claim 1, wherein the electroconductive support structure engages the housing via an O-ring.

7. The telecommunications antenna according claim 1, comprising at least one non-electroconductive spacing element between the radiator and at least one of the electroconductive support structure and the radome.

8. The telecommunications antenna according to claim 1, wherein the support structure comprises at least one of a rotation aid, an angular indication and an angular indexing.

9. The telecommunications antenna according claim 1, wherein the fastener has a terminal end that terminates short of an end of the electroconductive support structure so that the fastener does not extend beyond the electroconductive support structure in the direction of the radiator.

10. The telecommunications antenna according to claim 1 wherein the non-electroconductive body is constructed as a claw with two legs.

11. The telecommunications antenna according to claim 10, wherein the claw is provided with biasing sections at its ends.

12. The telecommunications antenna according to claim 11, wherein the biasing sections protrude by around 0.6 mm beyond a reference plane, defined adjacent a fastener for tensioning the non-electroconductive body.

13. The telecommunications antenna according to claim 10, wherein, in a base area of the two legs, the claw has one of a protrusion or a biasing section protruding beyond a reference plane by around 0.2 mm, as defined adjacent to a fastener for tensioning the non-electroconductive body.

14. The telecommunications antenna according to claim 1, wherein the housing is executed cylindrically at least in the area of the radiator.

15. The telecommunications antenna according to claim 1, further comprising a pressure-responsive element.

16. The telecommunications antenna according to claim 1, further comprising at least one of a securing element or a guide in axial direction for the non-electroconductive body.

17. The telecommunications antenna according to claim 1, wherein two of the radiators are mounted on two electroconductive support structures disposed on respective distal sections of the radome and are executed in particular as similar parts.

* * * * *